US006505103B1

(12) United States Patent
Howell et al.

(10) Patent No.: US 6,505,103 B1
(45) Date of Patent: Jan. 7, 2003

(54) METHOD AND APPARATUS FOR CONTROLLING REMOTE LOCOMOTIVE OPERATION

(75) Inventors: Joseph J. Howell; Edward F. Routledge, both of Melbourne, FL (US)

(73) Assignee: GE Harris Harmon Railway Technology, LLC, Melbourne, FL (US)

( * ) Notice: Subject to any disclaimer, the term of this patent is extended or adjusted under 35 U.S.C. 154(b) by 76 days.

(21) Appl. No.: 09/677,301

(22) Filed: Sep. 29, 2000

(51) Int. Cl.[7] ..... G05B 17/00

(52) U.S. Cl. ..... 701/19; 701/20; 340/933; 340/995

(58) Field of Search ..... 701/19, 20; 340/933, 340/995; 342/42

(56) References Cited

U.S. PATENT DOCUMENTS

| | | | | |
|---|---|---|---|---|
| 4,582,280 A | | 4/1986 | Nichols et al. | 246/82 R |
| 4,739,328 A | | 4/1988 | Koelle et al. | 342/44 |
| 4,786,907 A | | 11/1988 | Koelle | 342/51 |
| 4,864,158 A | | 9/1989 | Koelle et al. | 327/31 |
| 5,039,038 A | | 8/1991 | Nichols et al. | 246/3 |
| 5,172,121 A | | 12/1992 | Beecher | 342/121 |
| 5,414,624 A | | 5/1995 | Anthonyson | 70/1 |
| 5,415,369 A | * | 5/1995 | Hungate | 246/267 R |
| 5,504,485 A | * | 4/1996 | Landt et al. | 342/42 |
| 5,720,455 A | * | 2/1998 | Kull et al. | 246/187 C |
| 5,737,710 A | | 4/1998 | Anthonyson | 70/1 |
| 5,760,742 A | | 6/1998 | Branch et al. | 342/457 |
| 5,892,441 A | | 4/1999 | Woolley et al. | 340/534 |
| 5,894,266 A | | 4/1999 | Wood, Jr. et al. | 340/539 |
| 5,917,433 A | | 6/1999 | Keillor et al. | 340/989 |
| 5,967,465 A | | 10/1999 | Lumbis et al. | 246/184 |
| 6,144,901 A | * | 11/2000 | Nickles et al. | 701/19 |

FOREIGN PATENT DOCUMENTS

| | | |
|---|---|---|
| JP | 11348784 | 12/1999 |

* cited by examiner

*Primary Examiner*—William A. Cuchlinski, Jr.
*Assistant Examiner*—Marthe Y. Marc-Coleman
(74) *Attorney, Agent, or Firm*—Scott R. Hayden; Carl A. Rowold; Holland & Knight LLP

(57) ABSTRACT

A transponder-based distributed power train control system using a plurality of transponders located between the track rails or along the track wayside for setting the control functions, for example the brake or throttle controls of the remote power units in a train. Each remote power unit includes a transponder reader and the transponder return signal provides a pointer into a look-up table. The look-up table value represents the control setting for the remote power unit for the read transponder.

20 Claims, 2 Drawing Sheets

METHOD AND APPARATUS FOR CONTROLLING REMOTE LOCOMOTIVE OPERATION

The present invention is directed in general to an apparatus and method for controlling operation of a remote locomotive in a train consist including a lead locomotive and one or more remote locomotives, and more specifically to such a method and apparatus for controlling remote locomotive operation when the remote locomotive is not in radio communication with the lead locomotive.

BACKGROUND OF THE INVENTION

A radio-based control system for trains having a lead unit and one or more remote units (or groups of remote units) in which the control functions of the remote units are controlled by radio command signals from the lead unit is know in the art. Generally, this system is referred to as communication-based distributed power train control. The terminology "unit" as used herein describes a single diesel/electric locomotive, a group of adjacent diesel/electric locomotives, a single electrically-driven power provider, a group of adjacent electrically driven power providers, a single control car and a group of adjacent control cars, where the control cars do not supply driving power to the train but are used to control power providers. The control functions transmitted from the lead unit to the one or more remote units generally include the throttle setting (also referred to as the throttle notch position), air brake (also referred to as the pneumatic brake) setting (handle position), and the dynamic brake setting (dynamic step position). As is known by those skilled in the art, the air brake setting is also communicated to the remote units by the brake pipe pressure.

The one or more remote units can be controlled independently or synchronously. In one embodiment of the communication-based distributed power train control system, the operator can segregate the combination of all the powered units, including the lead unit and the remote units into a front group and a back group. The dividing line between the front group and the back group is determined by the position of a slider under control of the locomotive operator. For example, if the train includes a lead unit, a first remote unit, and a second remote unit, the locomotive operator can define the front group as comprising the lead unit and the first remote unit, while the back group comprises the second remote unit. Altenatively, the locomotive operator can position the slider to define the front group as including only the lead unit, while the back group includes both the first and second remote units. The independent mode is operative to control the front group independently from the back group, as determined by the slider position. The locomotive operator can also define the front group to include the lead units and both the first and second remote units. In this configuration, the communication-based distributed power train control system is operating in the synchronous mode. In the independent mode the train operator in the lead unit individually commands and controls the back group to a different throttle or brake setting by way of a signal transmitted over the communications channel. For example, the independent control mode may be used when the train is descending a long grade. As the lead unit approaches the grade, the train operator will slow down the lead unit white retaining the back group in its previous throttle position. As the back group reaches the crest, the operator throttles down the back group using the communications-based distributed power train control system. The operator will apply the dynamic brakes on the back group as it descends. Finally, when both groups return to level track, the system is returned to the synchronous mode so that both groups are controlled identically. In the synchronous mode, the lead and remote units respond to the same signal on the control channel and thus are set to the same throttle, air brake or dynamic brake setting. Each remote unit also provides a acknowledgement response to the lead unit over the communications channel. In addition, alarm conditions that occur on a remote unit are brought to the attention of the lead-unit operator over the communications channel. Further details of a communications-based distributed power train control system as described above can be found in U.S. Pat. No. 5,039,038 or U.S. Pat. No. 4,582,280. In another embodiment of the communications-based distributed power train control system, the lead and remote units do not necessarily have to be divided into a front group and a back group, but rather each lead unit and remote unit can be independently controlled by appropriate communication signals from the lead unit.

Obviously, when a radio link cannot be established between the lead unit and the one or more remote units, the lead unit is unable to control the operation of the remote units. Loss of this radio link occurs when the train passes through a tunnel or when buildings, hills, or other topographical or man-made features obstruct the line of sight between the transmitting antenna and the receiving antennas. The locations along the railway where communications will be lost are generally known in advance by the train operator who can therefore appropriately set the remote unit (or back group) controls before communications is lost. In fact, in some situations the loss of communications may not be detrimental, as the train air brake system alone can provide sufficient control over the remote units while the communications channel is inoperative. For example, assume the train is travelling through a tunnel with a relatively steep descent beginning midway through the tunnel. When the lead unit reaches the crest of the descent, the operator will throttle back the lead unit to slow the train. Because radio communications are disrupted in the tunnel, the remote units will continue to operate at their previous throttle setting. The communications-based distributed power train control system includes a timer feature to log the time interval between messages from the lead unit. That is, in one embodiment, the time interval is set at 45 seconds. A timer in the remote units is activated at the conclusion of a communications message from the lead unit. If the 45 seconds times out before the receipt of another message, then the lead units automatically begin to gradually throttle down from their current throttle notch position to the idle position.

Notwithstanding the timer feature, as the train descends through the tunnel, its speed increases and the operator applies the air brake to reduce the train speed. Although there is no communications link to the remote units, the air brake application at the lead unit is transmitted to the remote units via the brake pipe and therefore the remote units will also begin air brake application. The operator can then utilize the dynamic brake system on the lead unit to further adjust the train speed. In this scenario the lack of radio communication between the lead and remote units is not detrimental as adequate train control can be maintained, without radio communications.

Consider the case of a train entering a tunnel where the tunnel has a relatively steep ascent. If both the lead and remote unit throttles cannot be set to a higher notch position as each powered unit reaches the ascent, the train will be unable to climb the hill. The loss of communications in this scenario results in a stalled train. To overcome this disadvantage, tunnels are equipped with one or more repeater units placed proximate the track for receiving and re-transmitting the communications signal. A signal to increase the throttle notch position, for example, is received by the repeater and transmitted to the remote units. Generally, the tunnels are lined with leaky coaxial cable for use as the radiating element. Because the repeaters and leaky coax are expensive to install and maintain, it is desirable to seek a low cost solution, while providing remote unit control in the absence of a radio link between the lead unit and the remote units.

BRIEF SUMMARY OF THE INVENTION

Thus, there is a particular need to provide for the control of locomotive remote units during transit over certain railway topographies where a communications link cannot be established between the one or more remote units and the lead unit. According to the teachings of the present invention, transponder devices are placed between the rails or along the track wayside to provide control information as a remote unit (or a lead unit) with a reading device passes over or proximate the transponder.

BRIEF DESCRIPTION OF THE DRAWINGS

The present invention can be more easily understood and the further advantages and uses thereof more readily apparent, when considered in view of the description of the preferred embodiments and the following figures in which.

DETAILED DESCRIPTION OF THE PREFERRED EMBODIMENTS

Figure 1:
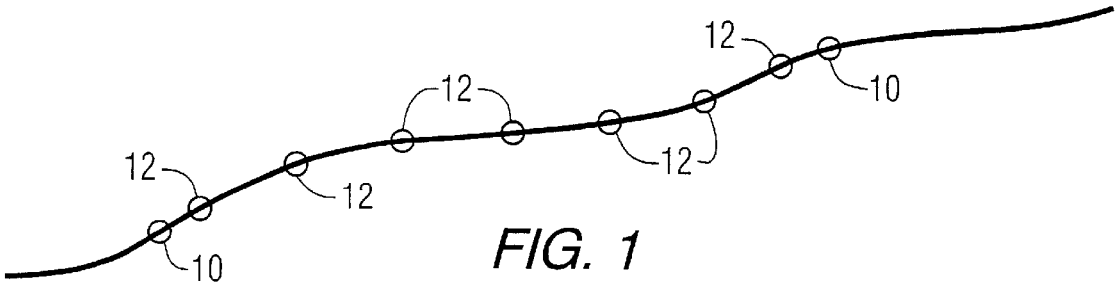
FIG. 1 illustrates the placement of transponders along a portion of a railroad network.

Before describing in detail the particular transponder-based distributed power train control system of the present invention, it should be observed that the present invention resides primarily in a novel combination of elements and method steps. Accordingly, the hardware components and method steps have been represented by conventional elements in the drawings, showing only those specific details that are pertinent to the present invention so as not to obscure the disclosure with structural details that will be readily apparent to those skilled in the art having the benefit of the description herein.

FIG. 1 is a schematic representation of a portion of a railroad network wherein a plurality of transponders 10 and 12 have been installed. The transponders 10 and 12 are mounted between or proximate (e.g., along the track wayside) the rail wherever a communications link between the lead locomotive unit and one or more remote units is hampered by topographical or man-made interference. In one embodiment, the selection of either the communications-based distributed power train control system or the transponder-based distributed power system is dictated by the signal-to-noise ratio on the link. If the signal-to-noise ratio falls below a predetermined threshold, then the transponder system in accordance with the present invention is activated.

In another embodiment, the locomotive operator will know the rail segments where transponders are installed and accordingly realize that the communications-based distributed power train control system will likely not function, in favor of the transponder-based distributed power train control system along those segments. Further, in yet another embodiment, the transponder zone begins before communications is lost so that several transponders will be read and the remote units appropriately controlled before the train operator relinquishes control over the units via the communications link. Thus, the train operator can be assured that the transponder-based distributed power train control system is functioning properly.

Figure 2:
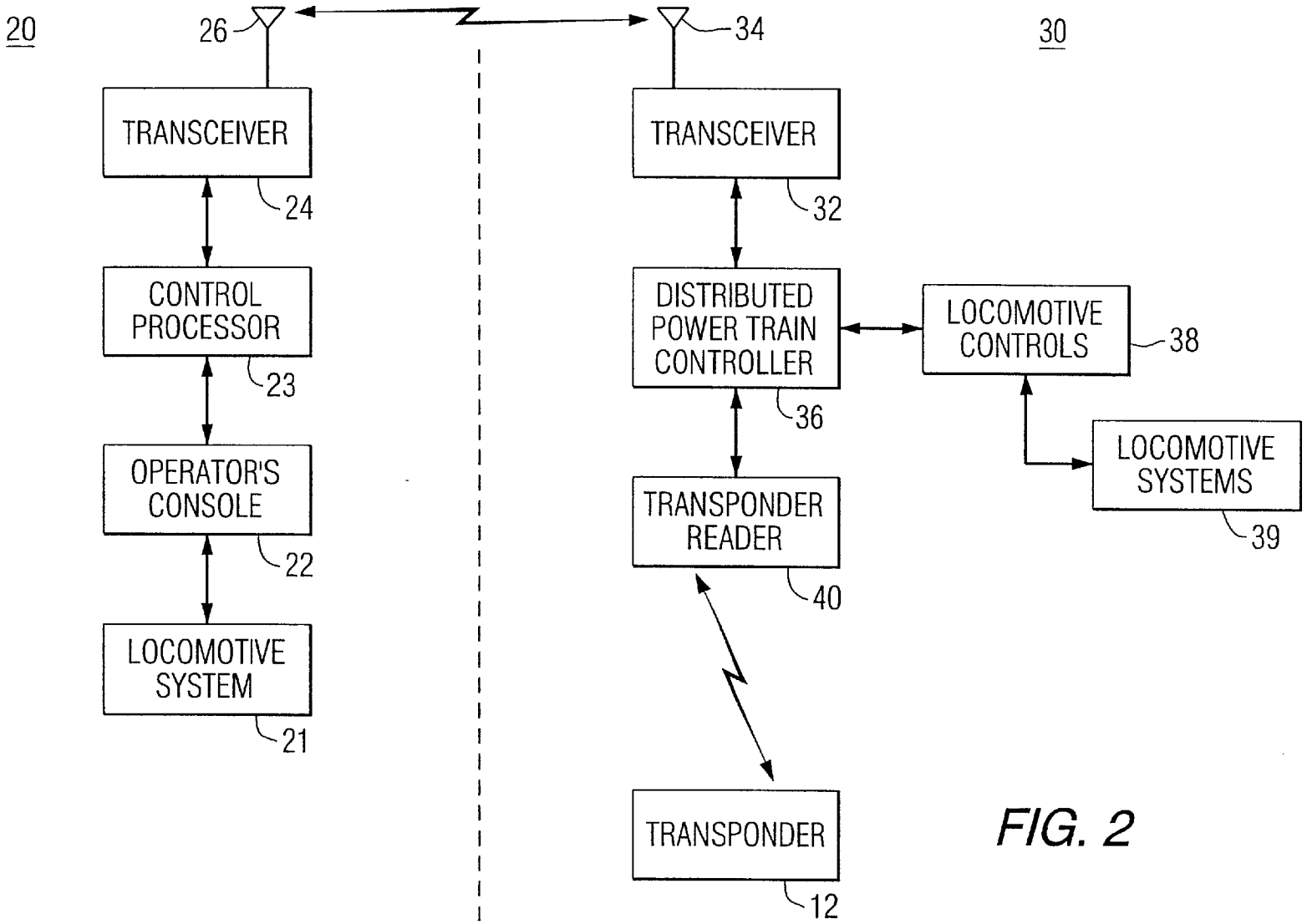
FIG. 2 is a block diagram showing the principal component of the present invention.

Turning to FIG. 2, there is shown the relevant components of the communications-based and the transponder-based distributed power train control systems as mounted on a lead unit 20 and a remote unit 30. A train consist comprises a single lead unit 20 (or a group of lead units) and one or more distributed remote units 30 controlled by signals conveyed over the communications link between the lead unit 20 and the remote unit 30. In most cases, the locomotive power is equipped to be set up and operated as either a lead unit or a remote unit, for ease of train make up logistics. Only one remote unit in a consist of adjacent remote units must be equipped with the communications-based and transponder-based distributed power train control system, as the adjacent units are controlled from the unit so equipped via the multiple unit (MU) interconnecting lines. The lead unit 20 includes an operator's console 22 from which the train operator controls operation of the lead unit locomotive systems shown generally by reference character 21. Control signals for the remote units are also generated at the operator's console 22, input to a control processor 23, and the output signals therefrom are input to a transceiver 24 for modulating a carrier signal transmitted to the remote units 30 via an antenna 26. A transceiver 32 within the remote unit 30 is responsive to the received signal via an antenna 34. The received signal is demodulated, decoded and input to a distributed power train controller 36. In response to the signals input thereto, the distributed power train controller 36 provides one or more signals to the locomotive controls 38 for controlling the various locomotive systems 39 of the unit or units, including: throttle notch position, dynamic brake position, reverser position (determining either the forward or reverse direction) and air brake application (either the application or the emergency mode).

A transponder reader 40 is responsive to a signal received from a transponder 12, as will be discussed further hereinbelow, for also providing signals to the distributed power train controller 36. When the communications channel between the lead unit 20 and the remote unit 30 is available, the distributed power train controller 36 utilizes the received signal to control the locomotive controls 38, (i.e. the communications-based distributed power train control system). In those situations where a communications link cannot be established or the signal-to-noise ratio (or other communication link metric, such as the bit error rate) falls below a minimum threshold, the distributed power train controller 36 uses signals supplied by the transponder reader 40 to control operation of the remote unit 30, (i.e., the transponder-based distributed power train control system as taught by the present invention). Further, as discussed above, the transponder-based distributed power train control system is activated prior to loss of the communications link to ensure proper operation of the transponder-based system. Activation occurs when the first transponder is read and a message is displayed on the operator's console that the units have entered a transponder zone and the transponder-based distributed power train control system is now controlling the remote units.

Although the lead unit 20 does not necessarily require implementation of the communication-based distributed power train control or transponder-based distributed power train control system of the present invention, because it is controlled directly by the locomotive operator, the lead unit 20 can include the distributed power train controller 36 and the transponder reader 40 to control the locomotive functions in those situations where a particular locomotive is switched between lead unit and remote unit service or transponder control where precision deems it necessary.

Returning to FIG. 1, the transponders 10 define zone boundaries where operation in the transponder control mode either begins or ends. The boundary transponders 10 are used solely to define the beginning and end of a transponder portion of the railroad network; in one embodiment they do not provide any information for train control. Advantageously, in accord with the teachings of the present invention, it is not necessary to provide transponders over the entire railway network. Instead, transponders are placed only in those areas where communications between the lead unit 20 and the remote unit 30 is impaired. Generally, the cost of installing and maintaining the transponders 10 and 12 is less than the cost of alternative prior techniques such as tunnel repeaters using leaky coax as the radiating element. The transponders can also be advantageously utilized in those situations were precise low-speed train control is required, such as while loading and unloading hopper cars. It is not required that the spacing between the transponders 10 and 12 be equal. Instead, the spacing is determined by the railway topography. As the topography changes more drastically, it may be necessary to space the transponders 10 and 12 at shorter intervals to retain optimum control over the remote units 30. Conversely, if the railway topography is generally constant, the transponders 10 and 12 can be spread farther apart as train control system adjustments will be required less frequently.

The transponders 10 and 12 are activated by an electromagnetic field generated by the transponder reader 12. The transponder reader 12 is located on the side of (for wayside-located transponders) or beneath (for transponders located between the rails) the locomotive. A small portion of the radio frequency energy transmitted by the transponder reader 40 is received by a coil within the transponders 10 and 12 for energizing the transponders 10 and 12. Once energized, the transponders 10 and 12 transmit a return signal, including a unique identifier, to the transponder reader 40. In another embodiment, the transponder reflects a small portion of the radio frequency back to the transponder reader. The reflected signal denotes the transponder's unique identification code and other stored data in accordance with the present invention. In response to the unique transponder identification code, the distributed power train controller 36 provides a predetermined control signal to the locomotive controls 38 for controlling the locomotive systems 39. The predetermined control signal can be provided, for example, through the use of a three-dimensional look-up table, where a first index into the table is the unique transponder identifier and a second index into the table is the direction of train travel. The value derived from the table is or represents the predetermined control signal. The control signal may include, for example, the throttle notch position, the dynamic brake step, and/or the air brake setting. The direction of travel variable is especially important in hilly or mountainous regions as the train control parameters will be reversed for the downhill train as compared to the uphill train. A technique for determining the direction of travel is discussed below. Transponders suitable for application to the teachings of the present invention are available from Aimtech of Dallas, Tex. The transponders are also commonly referred to as tags or radio frequency identification devices (RFID).

In accordance with one aspect of the present invention, as the train traverses a portion of the railroad network where the transponders 10 and 12 are located, the remote unit or remote units 30 are controlled in a predefined sequence of system adjustments that occur in a repeatable and deterministic manner as the transponder reader 40 of the remote unit 30 reads each transponder 12. Advantageously, according to the teachings of the present invention, it is not necessary for the distributed power train controller 36 (or the remote units 30) to know the geographical location of the powered units. Instead the remote unit 30 is controlled based on the unique identifier assigned to each transponder 12. Thus, the transponder-based distributed power train control system of the present invention provides positive control over the remote locomotive unit when the communications link with the lead unit is not available. The transponder 12 can be placed at any necessary spacing to provide optimum control of the remote units 30.

In one embodiment, the operator of the lead unit 20 can elect to retain full air brake control while the remote unit is operating in the transponder-based distributed power train control mode. During operation in this mode, when the operator applies the air brakes from the lead unit, the application is transmitted via the brake pipe to the remote unit 30 for activation of the remote unit air brake system. Further, in the event that a communications link can be established over a portion of the track where transponders 10 and 12 have been installed, according to the teachings of the present invention the operator can select whether to engage the communications-based or the transponder-based distributed power train control system. Alternatively, the system can be configured to allow the commands sent via the communications link to take precedence over transponder-based operations.

Depending upon the train configuration (e.g. loaded, empty, passenger, freight) there may be more than one transponder database or more than one predetermined control signal associated with each entry in the transponder database, after the direction of travel is taken into consideration. That is, in response to the identification of a specific transponder and after determining the direction of travel, there will be a first predetermined control signal for setting the train controls in a first configuration if the train is an empty freight train and traveling in a first direction. There will be a second predetermined control signal for setting the train controls in a second configuration if the train is a loaded freight train and traveling in the first direction. Additional control signals will be provided from the data base for passenger trains, again, dependent on the travel direction. A portable unit, a computer (including a lap top) or the operator's console 22 is used to establish and to change the data base values associated with each transponder 12.

Figure 3:
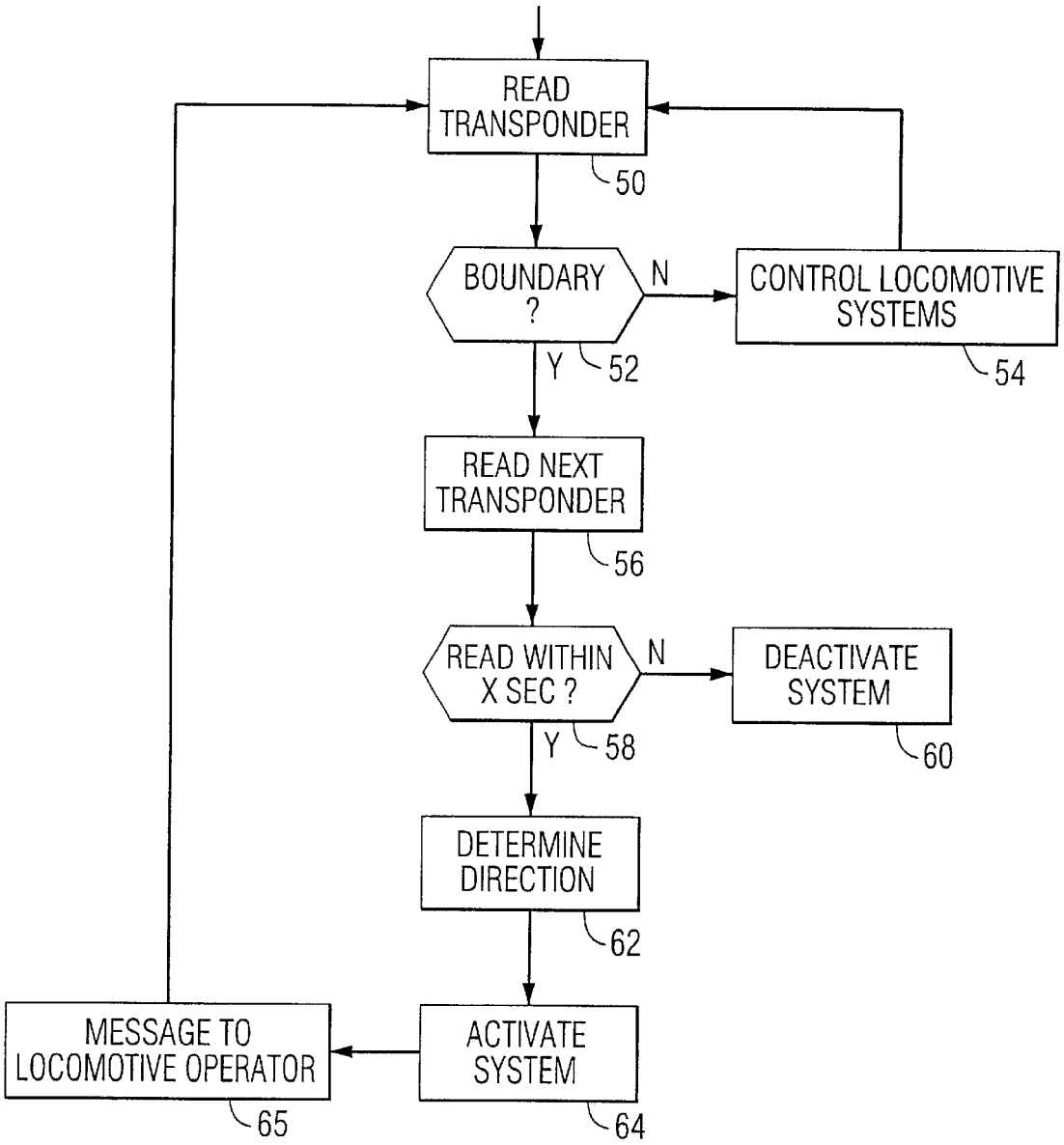
FIG. 3 is a software flow chart depicting the operational method of the present invention.

With reference to FIG. 3, there is shown a flowchart for activating the transponder distributed power train control system, for determining train direction and further for providing train control once the system has been activated. The transponder reader 40 reads a first transponder at a step 50 followed by a decision step 52 for determining whether the read transponder is a boundary transponder. Each boundary transponder produces a unique signal identifying itself as a boundary transponder and identifying the transponder zone with which it is associated. If the transponder is not a boundary transponder, then the system had been previously activated (and the direction of travel determined as will be explained below) and the database is consulted for determining the predetermined control signal for the remote unit 30 for the read transponder. As shown at a step 54, the train system controls are set in accordance with the response signal from the transponder. As other remote units in the consist read the transponder, the database on the remote unit is consulted to determine the predetermined control signal. Depending upon the topography and characteristics of the train, remote units distributed throughout the train may be set to different throttle or brake settings when a specific transponder is read.

If the read transponder is one of the boundary transponders 10, then the process moves from the decision step 52 to a step 56 where the next transponder is read. If the train is entering a portion of the rail network employing the transponder-based distributed power train control system, then the next transponder 12 will be read shortly after reading the boundary transponder 10, as determined by the train speed and the distance between transponders. If these two read operations occur within a predetermined interval, then the train has moved into a transponder portion. This process is indicated by a decision step 58. If the result of the decision step 58 is affirmative, then the direction of the train is determined based on the reading of two consecutive transponders, as indicated at a step 62. The reading of a boundary transponder 10 followed by an active transponder 12 (with no transponders read during a predetermined time interval there between) inherently determines the train direction as moving from the boundary transponder 10 toward the active transponder 12. Alternatively, the direction can be established, for instance, by assigning a number to each transponder 10 and 12 and including that number in the return signal from the transponder. Numbers read and processed by the transponder reader 40 in ascending order indicate a first direction of train travel and the predetermined control signal can be determined accordingly. If the numbers are read in descending order, then the train is traveling in a second direction, and again, the predetermined control signal is determined based on this second direction of travel. The transponder distributed power train control mode of operation is activated at a step 64, a message is displayed on the locomotive operator's console that the transponder-based distributed power train control system has been activated (step 65) and processing returns to the step 50 for reading the next transponder and all subsequent transponders within the transponder portion of the railroad network.

If a second transponder is not read within the predetermined interval after reading a boundary transponder 10, then the train has moved out of transponder area and the transponder-based distributed power train control mode is deactivated at a step 60. At this point, the lead unit operator regains control over the remote units via the communications-based distributed power train control system. But, the remote units remain in the same throttle/brake control setting as established by the last read transponder 12.

In one embodiment, each transponder responds to the interrogating radio frequency signal with a unique transponder identifier. For example, each boundary transponder 10 can include a signal that identifies the transponder as a boundary transponder. Further, each of the transponders 12 can include, within a portion of the return signal, an identifying number, where each transponder is numbered in sequence. In this way, if the transponder reader 40 identifies gap within the numerical sequence, this serves as an indication that a transponder 12 was moved or that the intervening transponders are not functional. In the event that a predetermined number of transponders are not functioning or in the event transponders are being read out of sequence, the transponder reader 40 and the distributed power train controller 36 can adjust the locomotive throttle to an idle position. Further, the system in accordance with the present invention, especially the transponder reader 40, must be equipped to distinguish those transponders associated with the present invention for providing locomotive control information from other transponders used by railroad operators. Again, a unique identification signal from transponders for controlling the locomotive remote units would suffice for this purpose.

In certain embodiments of the present invention where a single remote unit controls adjacent remote units via the MU (multiple unit) lines, only the controlling remote unit must be equipped with a transponder reader 40 in accordance with the present invention. Once the transponder reader 40 has received the response signal from the transponder 12, the predetermined control signal is obtained, the equipped remote unit is controlled accordingly and the adjacent remote units are controlled in the same manner via the MU line. As in known in the art, in a distributed power train control train, the remote locomotives can be distributed individually or in groups of adjacent locomotives throughout the train.

In yet another embodiment of the present invention, the transponders can be utilized to provide control over a lead locomotive unit. One example where this embodiment can be advantageously utilized is a situation where precise placement of hopper cars are required. In such an embodiment, the transponders can control the position of the locomotive to properly place the hopper cars.

While the invention has been described with reference to a preferred embodiment, it will be understood by those skilled in the art that various changes may be made and equivalent elements may be substituted for elements disclosed without departing from the scope thereof. In addition, modifications may be made to adapt a particular situation more material to the teachings of the present invention without departing from the essential scope thereof. Therefore, it is intended that the invention not be limited to the particular embodiment disclosed as the best mode contemplated for carrying out this invention but the invention will include all embodiments falling within the scope of the appended claims.

What is claimed is:

1. A method for controlling distributed power remote units of a train traveling over track rails in either a first or a second direction and including a lead power unit and one or more distributed power remote units, said method comprising:

(a) reading one or more transponders proximate the track rails;

(b) determining the direction of travel for the train;

(c) selecting a value from a reference table based on the results of steps (a) and (b); and (d) setting the control functions of the one or more distributed power remote units in accordance with the value obtained in step (c).

2. The method of claim 1 wherein the one or more transponders are placed between the track rails for reading by a transponder reader on each of the one or more distributed power remote units.

3. The method of claim 1 wherein the one or more transponders are placed adjacent the track rails for reading by a transponder reader on each of the one or more distributed power remote units.

4. The method of claim 1 wherein at least one of the one or more of the distributed power remote units includes a plurality of adjacent power units, and wherein only one of the adjacent power units executes the steps (a) through (d).

5. The method of claim 1 wherein the direction of train travel is determined based on the reading of two successive transponders of the one or more transponders.

6. The method of claim 1 wherein the one or more distributed power remote units are controlled according to a throttle notch position, a dynamic brake step, and an air brake handle position, and wherein setting the control functions includes setting one or more of the throttle notch position, the dynamic brake step and the air brake handle position.

7. The method of claim 1 wherein the reference table includes a multi-dimensional look-up table wherein the tabular value is determined by using at least one of the following parameters as an index into the look-up table, direction of train travel and train weight.

8. The method of claim 1 wherein the lead power unit is driven by an operator, and wherein said operator enables the reading of transponders proximate the track rails.

9. A method for controlling locomotives of a train including a lead locomotive and one or more remote locomotives, wherein the remote locomotives can be located individually or in remote groups of adjacent locomotives in the train, and wherein the train travels in either a first or a second direction over track rails, and wherein the track rails comprise a railroad network, and wherein the railroad network further comprises transponder segments having a plurality of transponders disposed proximate the track rails for reading by at least one of the individual remote locomotives and by at least one of the locomotives in at least one of the remote groups of adjacent locomotives, said method comprising:

(a) receiving a signal at a remote locomotive from a transponder, wherein the signal uniquely identifies the transponder;

(b) in response to the signal, determining one or more control settings for the reading remote locomotive; and (c) controlling the reading remote locomotive in response to the control settings determined at step (b).

10. The method of claim 9, wherein the transponders are read by each individual remote locomotive and by at least one locomotive in each remote group of adjacent locomotives.

11. The method of claim 10 wherein the reading locomotive in each remote group of adjacent locomotives communicates the control settings as determined at the step (b) to each locomotive in the group of adjacent locomotives.

12. The method of claim 9 wherein the transponders are placed between the track rails for reading by a transponder reader on at least one of the individual remote locomotives and by at least one of the locomotives in at least one of the remote groups of adjacent locomotives.

13. The method of claim 9 wherein the transponders are placed adjacent the track rails for reading by a transponder reader on at least one of the individual remote locomotives and by at least one of the locomotives in at least one of the remote groups of adjacent locomotives.

14. The method of claim 9 further comprising:

(d) determining when the reading remote locomotive has entered a transponder segment; and (e) activating a transponder reader on the reading remote locomotive for receiving a return signal from a transponder, wherein the return signal uniquely identifies the transponder.

15. The method of claim 9 wherein the step (b) further comprises:

(b1) in response to the signal, determining the direction of travel;

(b2) further in response to the signal, determining one or more control settings for the reading remote locomotive; and (c) controlling the reading remote locomotive in response to the direction of travel and the one or more control settings determined at the steps (b1) and (b2).

16. The method of claim 15 wherein the direction of travel is determined by reading the signal from two successive transponders and determining that the direction of travel is from the first transponder to the second transponder.

17. The method of claim 9 wherein the locomotives are controlled according to a throttle notch position, a dynamic brake step and an air brake handle position, and wherein the one or more control settings include the throttle notch position, the dynamic brake step, and the air brake handle position.

18. The method of claim 9 wherein the step (b) further includes determining the direction of train travel from which is determined the one or more control settings for the reading remote locomotive.

19. A method for controlling remote power units of a train including a lead power unit and one or more remote power units, and wherein the train travels in either a first or a second direction over track rails, and wherein the track rails comprise a railroad network, and wherein the railroad network further comprises transponder segments having a plurality of transponders disposed proximate the track rails for reading by at least one of the remote power units, said method comprising:

receiving a return signal from a read transponder at the reading remote power unit;

in response to the return signal, determining whether the read transponder is a boundary transponder;

if the read transponder is not a boundary transponder, setting the control functions of the reading remote power unit in response to a return signal;

if the read transponder is a boundary transponder, determining whether the reading remote power unit reads the next transponder within a predetermined time;

if the next transponder is not read within the predetermined time, terminating control over the reading remote power unit in accord with said method;

if the next transponder is read within the predetermined time, determining that the remote power unit has entered a transponder segment;

determining that the direction of travel is from the first read transponder toward the next read transponder;

reading the transponders on the transponder segment;

controlling the reading remote power unit in response to the return signals from the read transponders reading a boundary transponder by the reading remote power unit indicating that the reading remote power unit has exited the transponder segment.

20. An article of manufacture comprising:

a computer program product comprising a computer-usable medium having a computer-readable code therein for executing a method for controlling distributed power units of a train consist including a lead power unit and one or more remote power units, the computer-readable code in the article of manufacture comprising:

a computer-readable program code module for reading one of the transponders from a remote power unit;

a computer-readable program code module for determining whether the read transponder is a boundary transponder;

a computer-readable program code module for setting the control functions of the remote power unit that read the transponder in response to a return signal from the read transponder, if the read transponder is not a boundary transponder;

a computer-readable program code module for determining whether the remote power unit reads the next transponder of the transponder segment within a predetermined time, if the previously read transponder is a boundary transponder;

a computer-readable program code module for terminating control over the remote power unit in accord with said method, if the next transponder is not read within the predetermined time;

a computer-readable program code module for determining that the remote power unit has entered a transponder segment, if the next transponder is read within the predetermined time;

a computer-readable program code module for reading the transponders on the transponder segment; and a computer-readable program code module for controlling the remote power unit in response thereto until a boundary transponder is encountered and the remote power unit exits the transponder segment.

* * * * *